United States Patent [19]

Lubnow

[11] 3,946,696

[45] Mar. 30, 1976

[54] AUTOMATICALLY CONTROLLED MAGNETIC MINESWEEPING SYSTEM

[75] Inventor: Harold Lubnow, Panama City, Fla.

[73] Assignee: The United States of America as represented by the Secretary of the Navy, Washington, D.C.

[22] Filed: Dec. 5, 1969

[21] Appl. No.: 889,853

[52] U.S. Cl. ..... 114/221 R; 114/235 R; 89/1 M; 102/10

[51] Int. Cl.[2] ..... B63B 9/00

[58] Field of Search ..... 114/235, 221, 231

[56] References Cited

UNITED STATES PATENTS

| | | | |
|---|---|---|---|
| 2,397,209 | 3/1946 | Schaelchlin | 114/221 |
| 2,937,611 | 5/1960 | Schaelchin et al. | 114/221 |

*Primary Examiner*—Samuel Feinberg

*Attorney, Agent, or Firm*—Richard S. Sciascia; Don D. Doty; William T. Skeer

[57] ABSTRACT

The invention is an automatically controlled magnetic marine mine sweeping system that does not constitute a safety hazard to the ship deploying it. It includes a ship that trails a pair of electrodes within the water which are, in turn, electrically energized by a variable current generator to induce a magnetic field therein. The intensity of said magnetic field is sensed by a magnetometer; and by means of a closed-loop, negative-feedback circuit incorporating said magnetometer, said current generator, and said sea water, the intensity of said magnetic field is limited to the extent that it does not extend under the ship and detonate marine mines that are close enough to be destructive thereto.

18 Claims, 2 Drawing Figures

Harold A. Lubnow
INVENTOR.

BY

Don D. Doty
Attorney

AUTOMATICALLY CONTROLLED MAGNETIC MINESWEEPING SYSTEM

STATEMENT OF GOVERNMENT INTEREST

The invention described herein may be manufactured and used by or for the Government of the United States of America for governmental purposes without the payment of any royalties thereon or therefor.

FIELD OF INVENTION

The present invention relates generally to minesweeping systems, and, in particular, it is an improved method and means for electrically sweeping magnetically responsive marine mines with vastly improved safety for the personnel and associated equipment involved therein.

DESCRIPTION OF THE PRIOR ART

In the past, electrode type magnetic minesweeping systems have been employed with some degree of success. Unfortunately, however, they have not been so employed without an inordinate amount of hazard to operating personnel and associated equipment, due to the fact that the magnetic fields generated thereby sometimes detonated mines in sufficiently close proximity therewith to cause damage thereto.

It is well known that the effectiveness of an electrode type of magnetic minesweeping system is dependent upon the intensity and distribution of the magnetic field generated thereby, but, of course, the magnetic field generated is dependent upon the proper distribution of the sweep current, the effectiveness of which, in turn, is a function of the local geology and ambient environment. When the electrical characteristics of an area to be swept are known in great detail, it is possible to compute theoretically the magnetic field value which would render a sweep vessel reasonably safe under even the worst condition expected to be encountered. On the other hand, in the event such electrical characteristics are unknown because they vary from one area to another — as is usually the case during Naval minesweeping maneuvers — it has heretofore been necessary to manually set the sweeping magnetic field intensity to such reduced value as would obviously prevent it from detonating mines within destructive distance of the sweep vessel. Accordingly, in order for the sweep vessel to be safe at all times, it has been found that when using prior art magnetic minesweeping systems, the minesweeping operations must be accomplished at considerably reduced efficiency.

SUMMARY OF THE INVENTION

The subject invention overcomes most of the disadvantages of the aforementioned prior art systems, in that it automatically controls the minesweeping magnetic field in such manner that it does not detonate magnetically responsive mines located within the destructive range of the sweep vessel deploying it.

According to the invention, the magnetic field at a predetermined point below the sweep vessel is continuously sensed to produce an electrical value that is representative thereof. Then, in response to said electrical value, a unique negative feedback circuit automatically controls the current flowing between a pair of electrodes remotely disposed from said vessel. But because said flowing current generates the aforementioned sensed magnetic field, the control of the intensity thereof controls the range of said magnetic field. When the range thereof is set so that it will not extend under or near the sweep vessel, none of the magnetic mines in destructive proximity therewith will be exploded. Hence, the sweep vessel is safe from the magnetic mines being detonated by its own mine sweeping system.

It is, therefore, an object of this invention to provide an improved magnetic minesweeping system.

Another object of this invention is to provide a magnetic minesweeping system that will not detonate magnetic mines located in destructive proximity with the minesweeping vehicle deploying it.

A further object of this invention is to provide a method and means for making a minesweeping tractor vehicle safe from magnetic mines detonated by the magnetic field generated by its own minesweeping equipment.

A further object of this invention is to provide a method and means for protecting a minesweeping ship from the magnetic marine mines swept by the magnetic field generated by its own minesweeping apparatus.

Another object of this invention is to provide a method and means for efficiently and safely sweeping magnetic marine mines when the water and bottom characteristics that influence magnetic fields are not known.

Still another object of this invention is to provide an improved method and means for automatically controlling the amount of magnetic field generated within water, sea water, or any other aqueous medium.

A further object of this invention is to provide an improved method and means for generating an automatically controlled magnetic field within a predetermined environmental medium.

A further object of this invention is to provide an improved method and means for automatically controlling the radiation of a predetermined energy within a given volume of environmental medium.

Another object of this invention is to provide an improved method and means for automatically controlling the electric current transmitted within water, sea water, or any other aqueous medium.

Other objects and many of the attendant advantages will be readily appreciated as the subject invention becomes better understood by reference to the following detailed description, when considered in conjunction with the accompanying drawings.

DESCRIPTION OF PREFERRED EMBODIMENT

Figure 1:
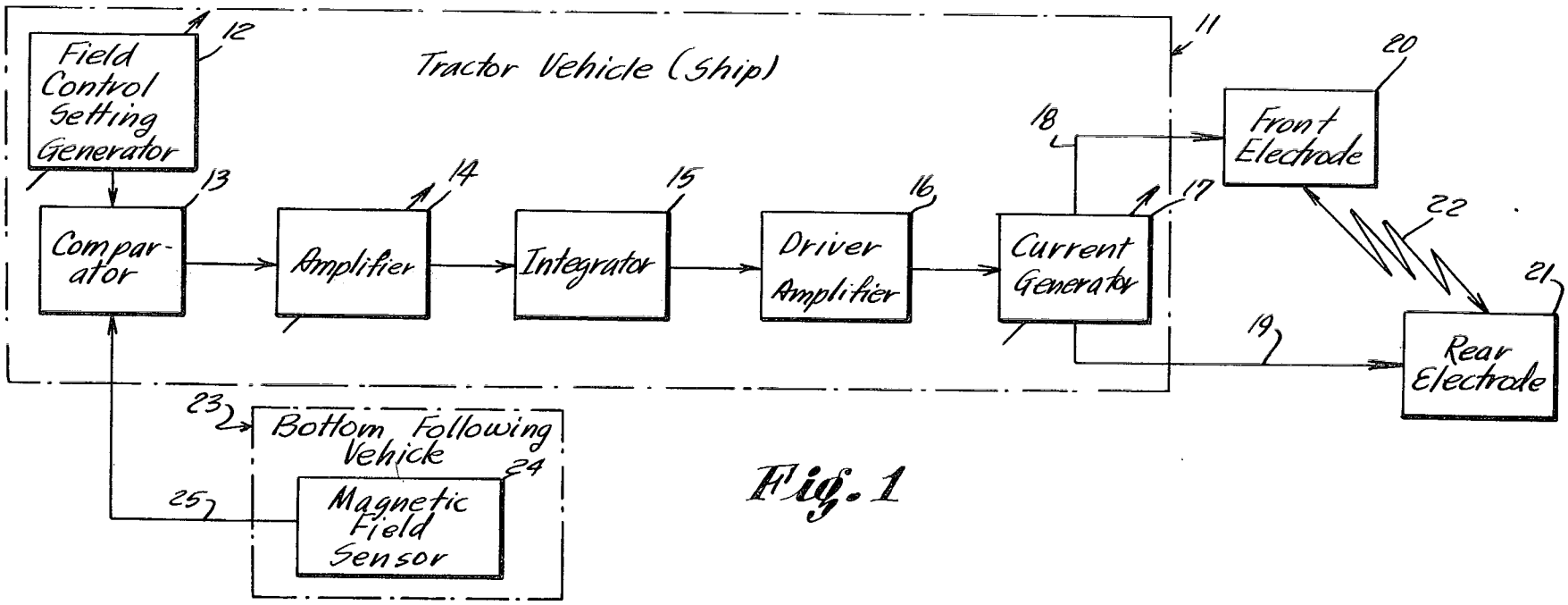
FIG. 1 is a block diagram of the system constituting this invention.

Referring now to FIG. 1, there is shown a tractor vehicle 11 which is used to carry, tow, push, deploy, or otherwise incorporate and facilitate the operation of the remainder of the subject system. It may be any vehicle that is suitable for functioning within the environmental medium involved during any given operational circumstances. For example, it may be a minesweeper, ship, submarine vehicle, aircraft, space craft, or the like; or, it could be a fixed platform, floating platform, or other mounting means, as desired.

Disposed within tractor vehicle 11, is a magnetic field control setting generator 12, with the output thereof connected to one of the inputs of a comparator 13. The output of comparator 13 is connected through a variable gain amplifier 14 to the input of an integrator 15, and the output of integrator 15 is connected through a driver amplifier 16 to the control input of a current generator 17. Integrator 15 is a typical discharging type of integrator, the rate of discharge of which is designed to be sufficiently rapid for sensitive control but not so rapid as to produce inaccuracies in the operation thereof. Obviously, the proper choice of the RC time constant incorporated therein will effect optimum charge and discharge conditions and, thus, will provide the sensitivity required for any given operational situations.

At this point, it would also apparently be noteworthy that for the purpose of controlling the aforementioned electric current or electric field automatically, the control input of current generator 17 is employed, and, thus, current generator 17 should be so designed for such control operation. However, it should not be limited thereto; therefore, it should also be designed for manual control as well. Hence, it is disclosed herein as being a manually variable current genreator, too.

As a general rule, it is preferable for the aforesaid elements to be mounted on or in tractor vehicle 11. On the other hand, any other useful disposition thereof may be employed which would facilitate the operation of the entire system. Obviously, it would be well within the purview of one skilled in the art having the benefit of the teachings presented herewith to make such a design choice with respect thereto that would optimize the subject invention for any given purpose.

The outputs of current generator 17 are connected by insulated electrical cables 18 and 19 to the inputs of front and rear electrodes 20 and 21, respectively. Inasmuch as cables 18 and 19 are to be streamed or deployed within an environmental medium which might be hostile thereto, they should be so designed as to conduct large electrical currents without breaking down from an insulation standpoint or from a current carrying standpoint. Likewise, electrodes 20 and 21 should be designed to withstand the attack of their ambient element and still effect the transmission of electrical current 22 therebetween.

As will be discussed subsequently in conjunction with FIG. 2, cables 18 and 19 are of such different lengths as to cause front electrode 20 to be located some predetermined distance from rear electrode 21 within the environmental medium.

Within another carrier vehicle 23 is located a sensor 24, which, in this particular application, is considered to be a magnetic field sensor. Of course, for other possible applications, it might be more useful if it were designed to be some other kind of sensor, such as, for example, an electric current sensor, an electric field sensor, or perhaps some suitable analog sensor. However, for the purpose of disclosing this preferred embodiment of the subject invention, said magnetic sensor may be a magnetometer or the like.

Carrier vehicle 23 may likewise be any suitable vehicle which can be towed, pushed, or self-propelled through the environmental medium involved. It also may be predetermined parameter controlled or associated vehicle, such as, for instance, a bottom following vehicle, in the event it is an underwater vehicle, and if such is desired.

The output of magnetic sensor 24 is connected via an electrical conductor and stress carrying cable 25 to the other input of the aforesaid comparator 13. Ordinarily, cable 25 acts as either a tow cable or a tether, as well as an electrical conductor means; however, if so desired, in the event the location of vehicle 23 is otherwise controlled so as to be at the proper place at the proper time for parameter sensing purposes, the tow or tether aspect thereof may be deleted. Moreover, it should be understood that any other appropriate telemetering link may be substituted for the electrical conductor aspect thereof, too, without violating the spirit and scope of the claimed invention. However, the foregoing notwithstanding, it may readily be seen that vehicles 23 and 11 of the presently disclosed preferred embodiment are physically connected and sensor 24 and comparator 13 are electrically connected by cable 25.

It should also be understood that all of the elements indicated by blocks in the block diagram of FIG. 1 are well known and conventional per se; hence, it is their respective interconnections and interactions that effect the instant invention and cause the new and useful results to be produced thereby.

MODE OF OPERATION

The operation of the invention will now be discussed briefly in conjunction with both of the figures of the drawing.

Although it may readily be appreciated that the invention may be operated within any environmental medium merely by properly designing the various elements thereof, for the purpose of disclosing it in as simple a manner as possible, it will be disclosed as a magnetic mine sweeping system for sweeping magnetically responsive marine mines that are located within sea water or that are laying on, partially submerged in, or buried within the sea floor. Also, for further simplicity of disclosure, like reference numerals for like elements have been used in both FIGS. 1 and 2, insofar as it is possible to do so.

Figure 2:
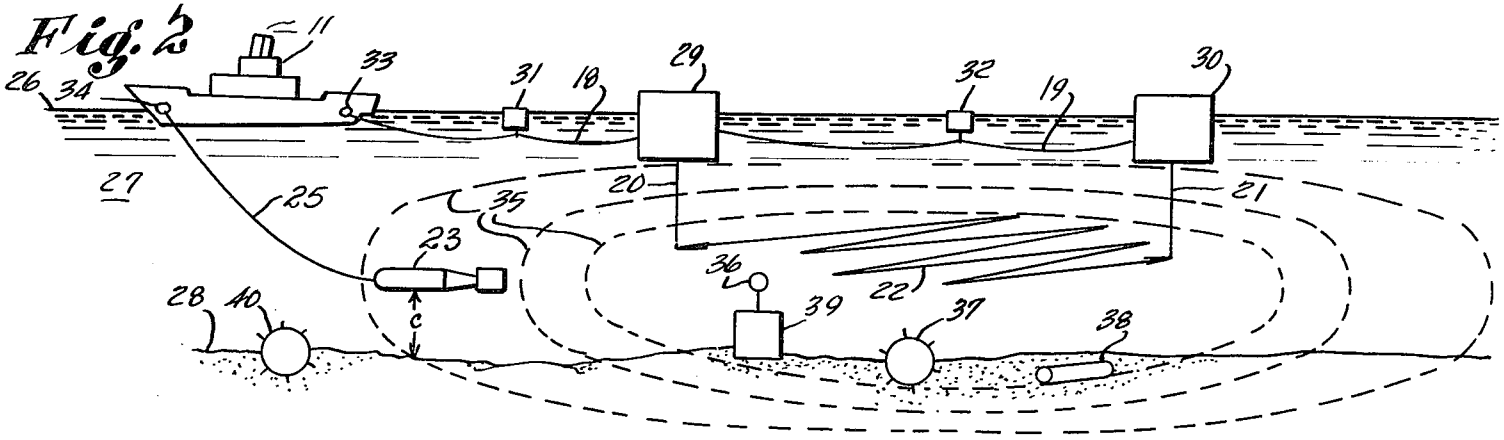
FIG. 2 is a quasi-pictorial view which illustrates an exemplary deployment, operation, and use of the subject invention.

As depicted in FIG. 2, ship 11 sails on the surface 26 of sea water 27 suspected of having magnetic mines therewithin or on floor 28 thereof. By means of cables 18 and 19, front and rear electrodes 20 and 21 are streamed at different distances behind ship 11. In order to dispose said electrodes within the water at an optimum distance from the surface thereof, they are respectively suspended from a pair of floats 29 and 30, and in order to facilitate the towing thereof without interference of cables 18 and 19, said cables are likewise connected to floats 31 and 32. Only two such floats have been shown herein; however, and many as necessary or desired may be used to support said cables.

For the purpose of paying out and hauling in said cables 18 and 19, a suitable powered winch or reel 33 mounted on ship 11 is connected thereto.

A bottom following vehicle 23 containing magnetic field sensor 24 is towed by cable 25 beneath and slightly astern of ship 11. It, too, may be paid out or hauled in by means of a ship-mounted, powered reel or winch 34. Of course, the exact position of sensor 24 is effected by the proper paying out of cable 25.

In such operational procedures, it is usually preferable to know the exact position of sensor 24, but this may be accomplished by any suitable means, such as by a conventional sonar or other echo-search-ranging system. Minesweeping ships always have such systems available for such use; however, in the case of necessity, if the water conditions were favorable, it could be done visually, or, in the alternative, it could be done by using a calibrated cable pay out. Thus, if cable 25 were paid out at a certain distance and ship 11 were traveling at a certain speed, it would be indicative of the probable position of towed bottom following vehicle 23.

A bottom following vehicle is preferably employed in order to increase the accuracy of the system. Such vehicles are likewise conventional and, thus, it will not be described further herein. When used, it will be guided to travel at some optimum constant distance C from sea floor 28.

As ship 11 travels along, current generator 17 supplies electrodes 20 and 21 with electrical current, which then travels as current 22 through water 27 to complete the circuit therebetween. As current 22 is transmitted through water 27, there is induced therein and within the sea floor a complex magnetic field 35 which, if strong enough, will actuate magnetic mines 36, 37, 38 encompassed thereby, regardless of whether thay are floated from an anchor 39 (such as mine 36 is shown to be), partially submerged within sea floor 28 (such as mine 37 is shown to be), or completely buried within sea floor 28 (such as mine 38 is shown to be). Of course, when mines 36, 37, and 38 are actuated they explode and thus destroy themselves, thereby preventing their subsequent explosion in response to friendly ships or other marine vehicles passing thereover, and, hence, such ships or marine vehicles have a safe passage.

However, such system and the minesweeping procedures effected thereby usually adversely expose ship 11 to safety hazards whenever magnetic field 35 is sufficiently intense to extend under it or within a certain destructive distance of it and detonate any mines 40 that may be located thereat. Therefore, it may readily be seen that the only way to insure the ship's safety is to prevent any mine 40 over which it is passing from being exploded at that time. But, the only way to prevent mine 40 from being ultimately exploded to the detriment of ship 11 is to control the strength of magnetic field 35, so that it will never extend therebeneath or in other destructive proximity therewith. Such control is effected by automatically controlling the current supplied to electrodes 20 and 21 by current generator 17.

To effect such control, the overall system of this invention — which, in fact, is a specialized, unique negative-feedback, closed-loop system — incorporates magnetic field sensor 24. When magnetic field sensor 24 senses that the intensity of magnetic field 35 is too great for safety, it must be reduced; otherwise, it could extend under or near to ship 11 and detonate mine 40. Sensor 24 sends an electrical signal that is proportional to the intensity or strength of said magnetic field to comparator 13, where it is compared with the preset output electrical signal from field control setting generator 12. Because it has previously been calibrated, generator 12 produces an output signal which is known for any given intensity of field 35 for any given disposition of sensor 24. Hence, it may be set to regulate field 35 to any desired safe level.

For example, in the event magnetic field 35 is too strong, the input to comparator 13 from sensor 24 exceeds the preset input from field control setting generator 12, and an output error signal of polarity and magnitude proportional to the difference therebetween is produced by comparator 13. After amplification to a more useful level by amplifier 14, said difference signal is integrated with integrator 15 to insure that the maximum thereof is always the operative value. In addition to providing improved control accuracy — and, thus, greater safety — the employment of integrator 15 provides smoother signal output by effectively smoothing out fluctuations that may occur in the closed loop caused by magnetic field fluctuations that, in turn, are sometimes produced by unknown conditions within the subaqueous medium, within the sea floor, or within other environmental objects that may be present in influential quantities.

The integrated output signal from integrator 15 is amplified to a more useful power level by driver amplifier 16 and then supplied to the control input of current generator 17 for regulating the current 22 produced thereby in proportion thereto. Thus, it may be seen that when the magnetic field sensed by sensor 24 is too strong, said current is reduced, thereby reducing the intensity of the magnetic field induced in the water. Of course, a small induced field does not propagate as far as a large induced field and, therefore, it does not travel far enough to extend under ship 11 whenever the setting of field control generator 12 is properly made. On the other hand, if the sensed magnetic field 35 is too weak to compare with the setting of generator 12 — and, thus, is too weak to be effective as an efficient minesweeping field — an opposite polarity and magnitude error signal occurs in the closed-loop negative-feedback system and causes current 22 to be increased until the intensity of field 35 reaches its operationally effective set point intensity. As a result of such decreasing and increasing of said current at the proper rate, magnetic field 35 closely hunts about the magnetic field set point set in field control setting generator 12.

From the foregoing, it may be seen that magnetic field 35 is never allowed to be sufficiently great to extend under ship 11 and detonate any mines 40 located in sufficient proximity therewith to be detrimental thereto. Hence, ship 11 is safe from the operation of its own minesweeping apparatus. And because Naval, military, or other minesweeping maneuvers must be accomplished with maximum speed in order to provide maximum safety for personnel and equipment involved therein, it should be obvious to those who are expert in the minesweeping art that the subject method and means constituting this invention provide new, improved, and highly useful results not heretofore attained.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. A method of sweeping magnetically responsive marine mines to effect detonation of those thereof that are not located within destructive proximity of the minesweeping ship effecting the sweep thereof and to not effect detonation of those thereof that are located within destructive proximity of said minesweeping ship, comprising the combined steps of:

generating a magnetic field within the water and sea floor where said magnetically responsive marine mines are suspected of being located;

sensing the intensity of said magnetic field at a predetermined distance from said ship and producing a first signal proportional thereto;

controlling the intensity of said sensed magnetic field to prevent it from extending close enough to said minesweeping ship to detonate a magnetically responsive marine mine that may be in destructive proximity therewith by comparing said first signal that is proportional to said sensed magnetic field with a preset second signal that is calibrated to be proportional to a known distance from said minesweeping ship and producing a third signal that is proportional in polarity and magnitude to the difference therebetween; integrating said third signal in accordance with a predetermined time constant; and automatically regulating the generating of the aforesaid generated magnetic field in accordance with the polarity and magnitude of said integrated third signal, so as to equalize said first and second signals.

2. The method of claim 1 wherein said step of generating a magnetic field within the water and sea floor where said magnetically responsive marine mines are suspected of being located comprises the steps of:

generating an electric current;

transmitting said electric current through a predetermined amount of said water to induce said magnetic field therein and within the sea floor located thereunder.

3. The method of claim 1 wherein said step of sensing said magnetic field at a predetermined distance from said ship and producing a first signal proportional thereto comprises the step of disposing a magnetic field sensor within said water at a predetermined distance from said ship and said sea floor.

4. The method of claim 1 further characterized by the step of moving said generated magnetic field to transverse predetermined volumes of water and sea floor in response to the movement of said minesweeping ship.

5. A magnetic minesweeping system, comprising in combination:

a tractor vehicle for traversing a predetermined course within a predetermined environmental medium;

controllable means mounted on said tractor vehicle for generating an electric current;

means connected to said electric current generating means for broadcasting said electric current through a portion of said environmental medium to induce a magnetic field therein that has an intensity that is proportional thereto;

means adjustably, spatially disposed from said tractor vehicle for sensing the intensity of said magnetic field and for producing a first signal proportional thereto;

calibrated adjustable means for producing a predetermined second signal that is proportional to a given distance between said tractor vehicle and the magnetic field sensed by the aforesaid magnetic field sensing means;

means connected between the outputs of said magnetic field sensing means and said calibrated adjustable means for producing an error signal having a polarity and magnitude that is proportional to the amount said first signal is greater or less than said second signal, respectively; and means connected between the output of said error signal producing means and the control input of the aforesaid electric current generating means for the regulation thereof to substantially equalize said first and second signals in response to said error signal.

6. The device of claim 5 wherein said magnetic minesweeping system is a magnetic marine minesweeping system.

7. The device of claim 5 wherein said tractor vehicle for traversing a predetermined course within a predetermined environmental medium is a marine vehicle.

8. The device of claim 5 wherein said tractor vehicle is a minesweeping ship.

9. The device of claim 5 wherein said controllable means mounted on said tractor vehicle for generating an electric current comprises a variable electric current generator.

10. The device of claim 5 wherein said means adjustably, spatially disposed from said tractor vehicle for sensing the intensity of said magnetic field and for producing a first signal proportional thereto comprises a magnetometer.

11. The device of claim 5 wherein said means adjustably, spatially disposed from said tractor vehicle for sensing the intensity of said magnetic field and for producing a first signal proportional thereto comprises:

a guidable sea floor following vehicle adjustably tethered from said tractor vehicle; and a magnetometer mounted within said guideable sea floor following vehicle.

12. The device of claim 5 wherein said calibrated adjustable means for producing a predetermined second signal that is proportional to a given distance between said tractor vehicle and the magnetic field sensed by the aforesaid magnetic field sensing means comprising a field control setting generator.

13. The device of claim 5 wherein said means connected between the outputs of said magnetic field sensing means and said calibrated adjustable means for producing an error signal having a polarity and magnitude that is proportional to the amount said first signal is greater or less than said second signal, respectively, comprises a comparator.

14. The device of claim 5 wherein said means connected between the output of said error signal producing means and the control input of the aforesaid electric current generating means for the regulation thereof to substantially equalize said first and second signals in response to said error signal comprises an integrator having an input and an output, with the input thereof effectively connected to the output of said error signal producing means, and with the output thereof effectively connected to the control input of said electric current generating means.

15. The device of claim 5 wherein said means connected to said electric current generating means for broadcasting said electric current through a portion of said environmental medium to induce a magnetic field therein that has an intensity that is proportional thereto comprises:

a first insulated electrical cable of predetermined length, with one end thereof connected to an output of said electrical current generating means;

a first electrode connected to the other end of said first insulated electrical cable;

a second insulated electrical cable having a length that is greater than the length of said first insulated electrical cable, with one end thereof connected to an output of said electric current generating means; and a second electrode connected to the other end of said second insulated electrical cable.

16. The invention of claim 15 further characterized by means mounted on said tractor vehicle and connected to said first and second insulated electrical cables for the timely paying out and hauling in thereof.

17. The invention of claim 15 further characterized by first and second float means connected to said first and second electrodes for the support thereof within said predetermined environmental medium, respectively.

18. The invention of claim 17 further characterized by second and third float means connected to said first and second insulated electrical cables for the support thereof within said predetermined environmental medium, respectively.

* * * * *